US008016995B2

(12) United States Patent
Hou

(10) Patent No.: US 8,016,995 B2
(45) Date of Patent: Sep. 13, 2011

(54) ELECTROCHEMICAL DEPOSITION METHOD FOR SURFACE METALLIZATION

(75) Inventor: Kai-Chung Hou, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 832 days.

(21) Appl. No.: 12/061,648

(22) Filed: Apr. 3, 2008

(65) Prior Publication Data

US 2009/0134032 A1 May 28, 2009

(30) Foreign Application Priority Data

Nov. 23, 2007 (TW) ..... 96144373 A

(51) Int. Cl.
*C25D 1/00* (2006.01)

(52) U.S. Cl. ..... 205/70

(58) Field of Classification Search ..... 205/67, 205/70

See application file for complete search history.

(56) References Cited

U.S. PATENT DOCUMENTS 4,300,959 A * 11/1981 Hurwitz et al. ..... 148/518
5,000,826 A * 3/1991 Kitano ..... 205/67

* cited by examiner

*Primary Examiner* — Luan V Van
(74) *Attorney, Agent, or Firm* — Li & Cai Intellectual Property (USA) Office

(57) ABSTRACT

An electrochemical deposition method includes disposing a mold into an electrolytic bath for forming a first metal layer on a surface of the mold, bonding a first surface of a conductive component to the first metal layer, and disposing the mold bonded to the conductive component into an electrolytic bath for forming a second metal layer on a second surface of the conductive component.

9 Claims, 10 Drawing Sheets

ELECTROCHEMICAL DEPOSITION METHOD FOR SURFACE METALLIZATION

BACKGROUND OF THE INVENTION

1. Field of the Invention

The present invention relates to an electrochemical deposition method, and more specifically, to an electrochemical deposition method for surface metallization.

2. Description of the Prior Art

With rapid development of electronic technology, electronic apparatuses have become indispensable products in daily life. To meet consumers' needs, many electronic apparatuses have powerful functions and pleasing appearance. For appearance, an electronic apparatus with a metal case has many advantages, such as high intensity, EMI (Electro Magnetic Interference) shielding, and good thermal conduction, so it is popular in the market. However, applications of metal cases are limited, as a manufacturing process is more complicated and has higher cost than for a plastic case. Therefore, surface metallization has arisen accordingly.

In general, an electro-plating method or an electro-molding method is utilized for surface metallization. However, both of the aforementioned methods have respective drawbacks. The electro-plating method involves plating a metal surface on a surface of a mold via an electrolytic process. That is to say, the electro-plating method involves disposition of a mold into an electrolytic bath and connection of the mold to a negative pole of a battery. In such a manner, metal ions with positive electrical charge in the electrolytic bath may receive electrons on the negative pole to generate a uniform metal layer on the surface of the mold. But, if a manufacturer wants to perform an extra surface effect treatment on the surface of the mold, the only way is to perform texture treatment on the surface of the mold before utilizing the electro-plating method. In other words, the electro-plating method cannot perform special surface effect treatments (such as a brushed surface or a laser pattern) on the surface of the mold by itself. Another method is the electro-molding method. The electro-molding method begins with generating an electro-molding part, and then the electro-molding part is glued to the surface of the mold for generating special surface effects on the surface of the mold. However, the overall thickness of the surface according to the said method is greater than the overall thickness of the surface according to the electro-plating method, since there is an adhesive layer present between the electro-molding part and the surface of the mold when performing the electro-molding method. Furthermore, compared with other related methods, the electro-molding method also has a problem of low connecting strength. In addition to the two aforementioned methods, a method of spraying metal lacquer can also be utilized for surface metallization, but it has problems of low yield, poor reflection, and lack of a metal feel.

SUMMARY OF THE INVENTION

The present invention provides an electrochemical deposition method for surface metallization comprising: disposing a mold in an electrolytic bath for forming a first metal layer on a surface of the mold; bonding a first surface of a conductive component to the first metal layer; and disposing the mold bonded to the conductive component in an electrolytic bath for forming a second metal layer on a second surface of the conductive component.

The present invention further provides an electrochemical deposition method for surface metallization comprising: performing insulation treatment on a first partial surface of a mold; disposing the mold in an electrolytic bath for forming a first metal layer on a second partial surface of the mold; performing insulation treatment in a first partial area of a first surface of a conductive component; bonding a first partial area and a second partial area of a second surface of the conductive component to the first partial surface of the mold and the first metal layer respectively after performing the insulation treatment in the first partial area of the first surface of the conductive component; and disposing the mold bonded to the conductive component in an electrolytic bath for forming a second metal layer in a second partial area of the first surface of the conductive component.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
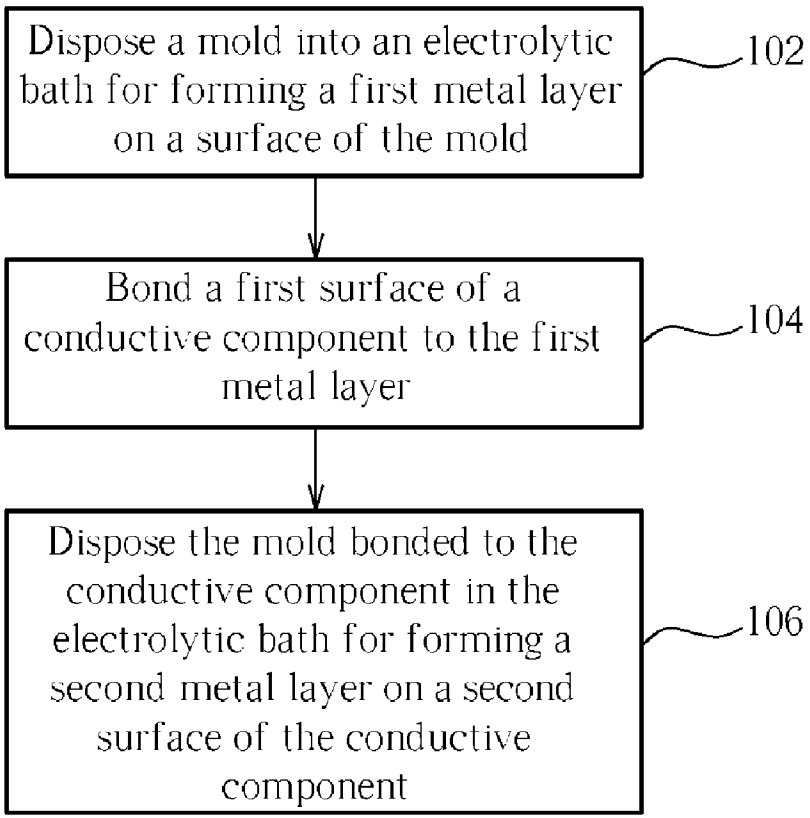
FIG. 1 is a flowchart of an electrochemical deposition method for surface metallization according to the first embodiment of the present invention.

Please refer to FIG. 1. FIG. 1 is a flowchart of an electrochemical deposition method for surface metallization according to the first embodiment of the present invention. The electrochemical deposition method comprises the following steps.

Step 102: Dispose a mold 10 into an electrolytic bath 12 for forming a first metal layer 14 on a surface of the mold 10;

Step 104: Bond a first surface 18 of a conductive component 16 to the first metal layer 14;

Step 106: Dispose the mold 10 bonded to the conductive component 16 in the electrolytic bath 12 for forming a second metal layer 22 on a second surface 20 of the conductive component 16.

Figure 2:
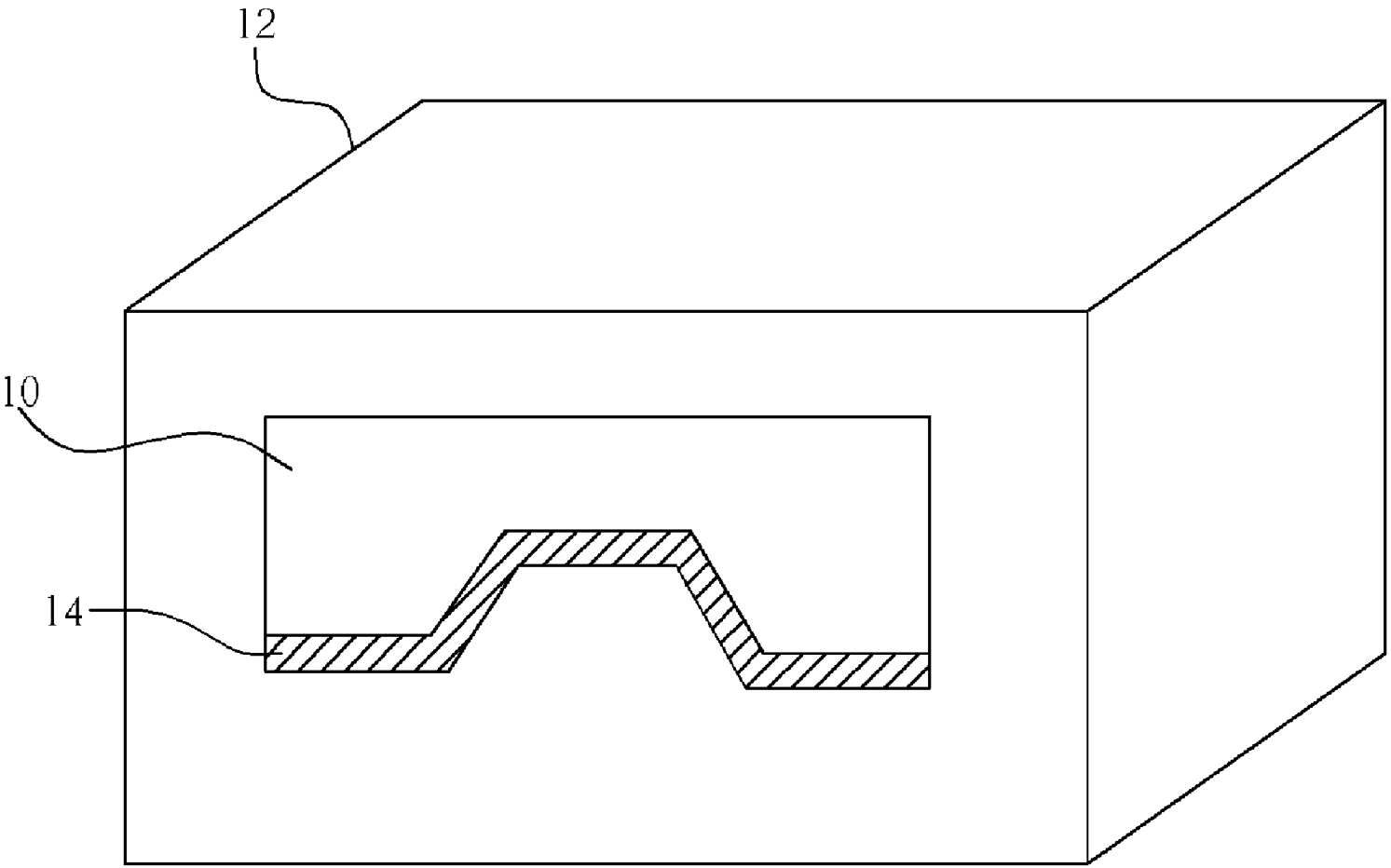
FIG. 2 is a diagram of forming a first metal layer on a surface of a mold mentioned in FIG. 1.

First, more detailed description for Step 102 is provided as follows. Please refer to FIG. 2. FIG. 2 is a diagram of forming the first metal layer 14 on the surface of the mold 10 mentioned in FIG. 1. As shown in FIG. 2, the mold 10 is disposed in the electrolytic bath 12 and connected to a negative pole of a battery. In such a manner, metal ions with positive electrical charge in the electrolytic bath 12 can receive electrons on the negative pole to generate the first metal layer 14 on the surface of the mold 10. In addition, before disposing the mold 10 in the electrolytic bath 12, a surface effect treatment (such as a brushed surface or a laser pattern) can be performed on the surface of the mold 10 first, so as to give the first metal layer 14 the corresponding surface effect, as the contour of the first metal layer 14 corresponds to the surface of the mold 10.

Figure 3:
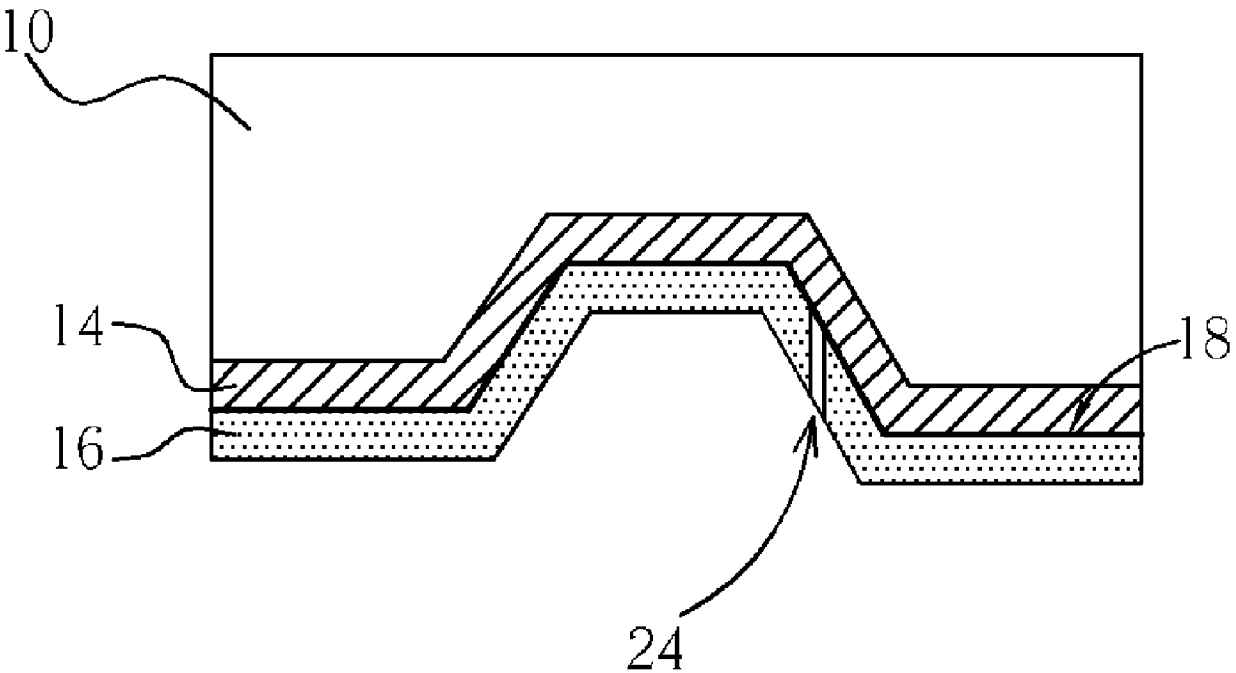
FIG. 3 is a diagram of bonding a conductive component to the first metal layer mentioned in FIG. 1.

Next, more detailed description for Step 104 is provided as follows. Please refer to FIG. 3. FIG. 3 is a diagram of bonding the conductive component 16 to the first metal layer 14 mentioned in FIG. 1. As shown in FIG. 3, the mold 10 can be taken out after forming the first metal layer 14 on the surface of the mold 10 in the electrolytic bath 12. Then, a first surface 18 of the conductive component 16 is bonded to the first metal layer 14 with an auxiliary tool (such as a fixing clip). The method of bonding the conductive component 16 to the first metal layer 14 is not limited to the said method. Common bonding methods according to the prior art may also be applied to the present invention. In addition, the conductive component 16 may be a conductor (such as a Mg—Al alloy) in itself, or may be transformed into a conductor by a conductive process (such as a conductive plastic component). As a result, if the conductive component 16 is made of the Mg—Al alloy, the step of bonding the conductive component 16 to the first metal layer 14 can be executed directly. On the contrary, if the conductive component 16 is made of the plastic material, as mentioned above, it is necessary to perform a conductive process first (such as spraying conductive lacquer) to transform the conductive component 16 into a conductor.

Figure 4:
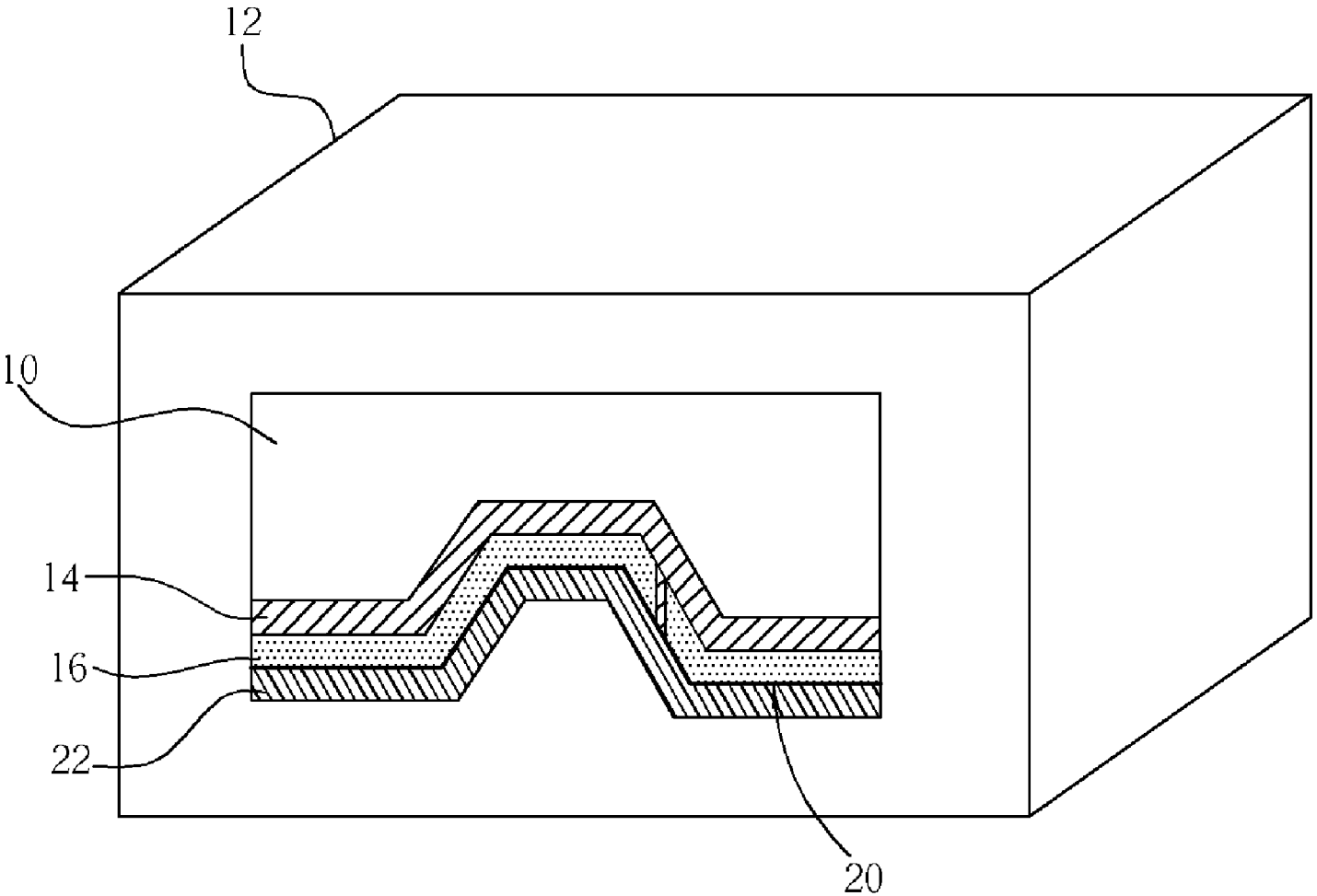
FIG. 4 is a diagram of forming a second metal layer on a surface of the conductive component mentioned in FIG. 1.

Finally, more detailed description for Step 106 is provided as follows. Please refer to FIG. 4. FIG. 4 is a diagram of forming the second metal layer 22 on the surface of the conductive component 16 mentioned in FIG. 1. As shown in FIG. 4, after bonding the first surface 18 of the conductive component 16 to the first metal layer 14, the mold 10 bonded to the conductive component 16 can be disposed in the electrolytic bath 12 for forming the second metal layer 22 on the second surface 20 of the conductive component 16. After the said steps (i.e. Steps 102-106) are executed in turn, surface metallization of the conductive component 16 is completed. Furthermore, a method of generating at least one hole 24 in the conductive component 16 (as shown in FIG. 3) is effective in increasing bonding strength of the first metal layer 14 and the first surface 18, and bonding strength of the second metal layer 22 and the second surface 20. That is to say, after the mold 10 bonded to the conductive component 16 is disposed in the electrolytic bath 12, the hole 24 would subsequently be filled with metal precipitated from the electrolytic bath 12. In such a manner, as shown in FIG. 4, the first metal layer 14 can be connected to the second metal layer 22 by the said precipitated metal in the hole 24. As a result, the bonding strength of the first metal layer 14 and the first surface 18 and the bonding strength of the second metal layer 22 and the second surface 20 can be further increased.

Figure 5:
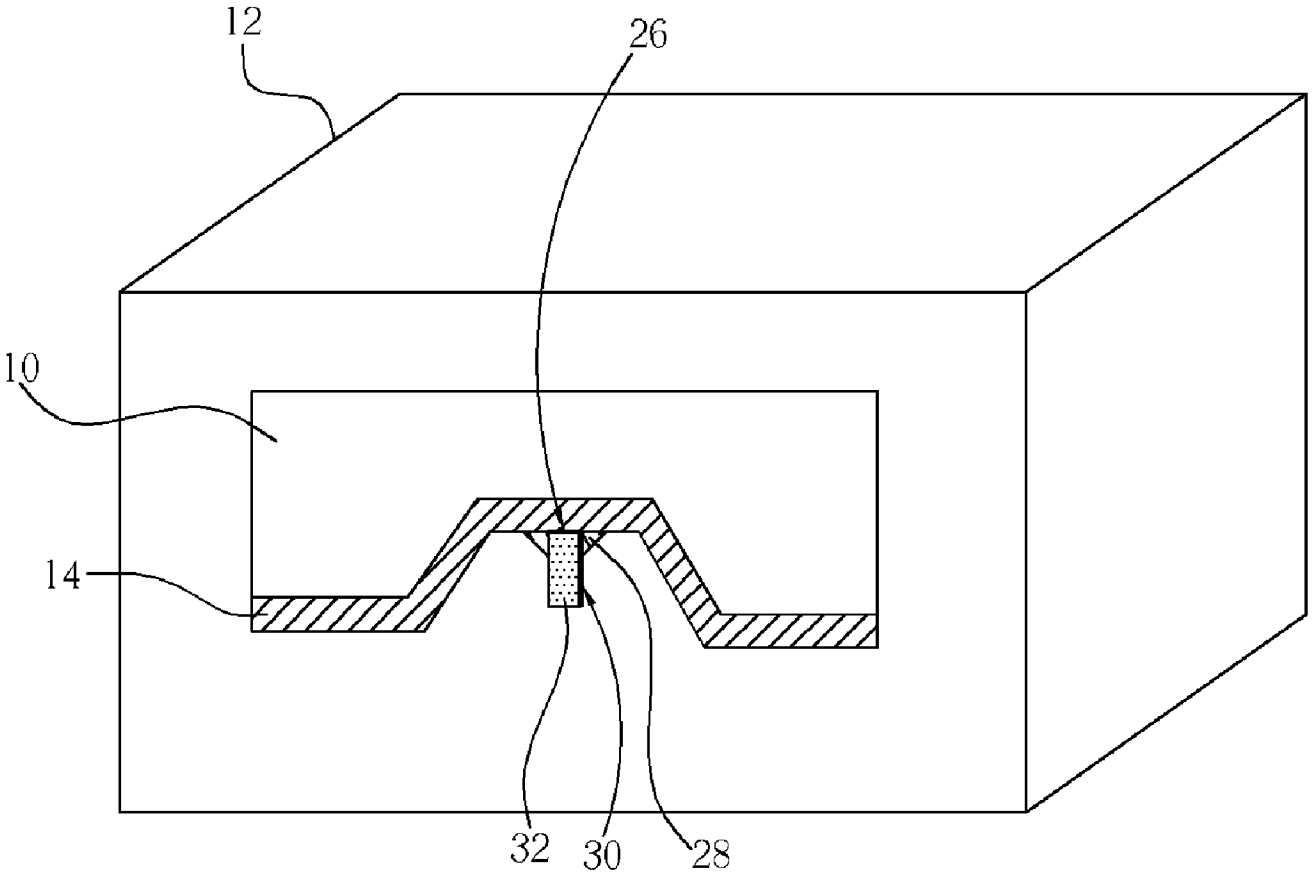
FIG. 5 is a diagram of implanting a conductive component partially into the first metal layer according to the second embodiment of the present invention.

It should be mentioned that the structure of the conductive component 16 is not limited to the structure corresponding to the first metal layer 14. Namely, the conductive component 16 may also be a component partially implanted in the first metal layer 14. Please refer to FIG. 5. FIG. 5 is a diagram of implanting a conductive component 32 partially in the first metal layer 14 according to the second embodiment of the present invention. Differences between the first and second embodiments include structure of the conductive component and how the conductive component is bonded to the metal layer. Components mentioned in both the first and second embodiments represent components with similar functions or similar positions. As shown in FIG. 5, a first surface 26 of the conductive component 32 is bonded to the first metal layer 14, and a second metal layer 28 is formed on a second surface 30 of the conductive component 32. As for other steps of the second embodiment, they are similar to the first embodiment and description is therefore omitted herein.

Figure 6:
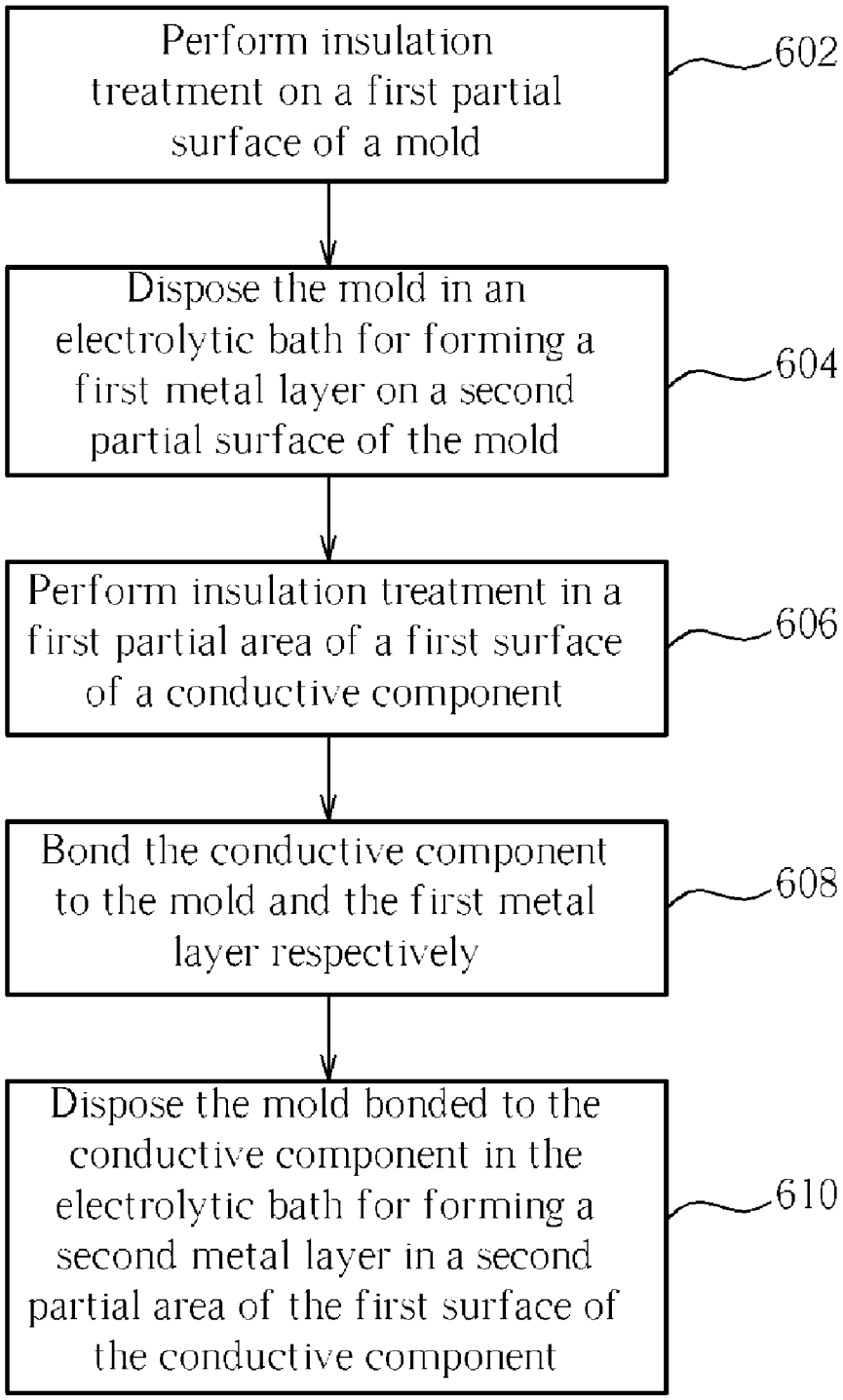
FIG. 6 is a flowchart of an electrochemical deposition method for surface metallization according to a third embodiment of the present invention.

Next, please refer to FIG. 6. FIG. 6 is a flowchart of an electrochemical deposition method for surface metallization according to a third embodiment of the present invention. The electrochemical deposition method comprises the following steps:

Step 602: Perform insulation treatment on a first partial surface 52 of a mold 50;

Step 604: Dispose the mold 10 in an electrolytic bath 54 for forming a first metal layer 58 on a second partial surface 56 of the mold 50;

Step 606: Perform insulation treatment in a first partial area 64 of a first surface 62 of a conductive component 60;

Step 608: Bond the conductive component 60 to the mold 50 and the first metal layer 58 respectively;

Step 610: Dispose the mold 50 bonded to the conductive component 60 in the electrolytic bath 54 for forming a second metal layer 74 in a second partial area 72 of the first surface 62 of the conductive component 60.

Figure 7:
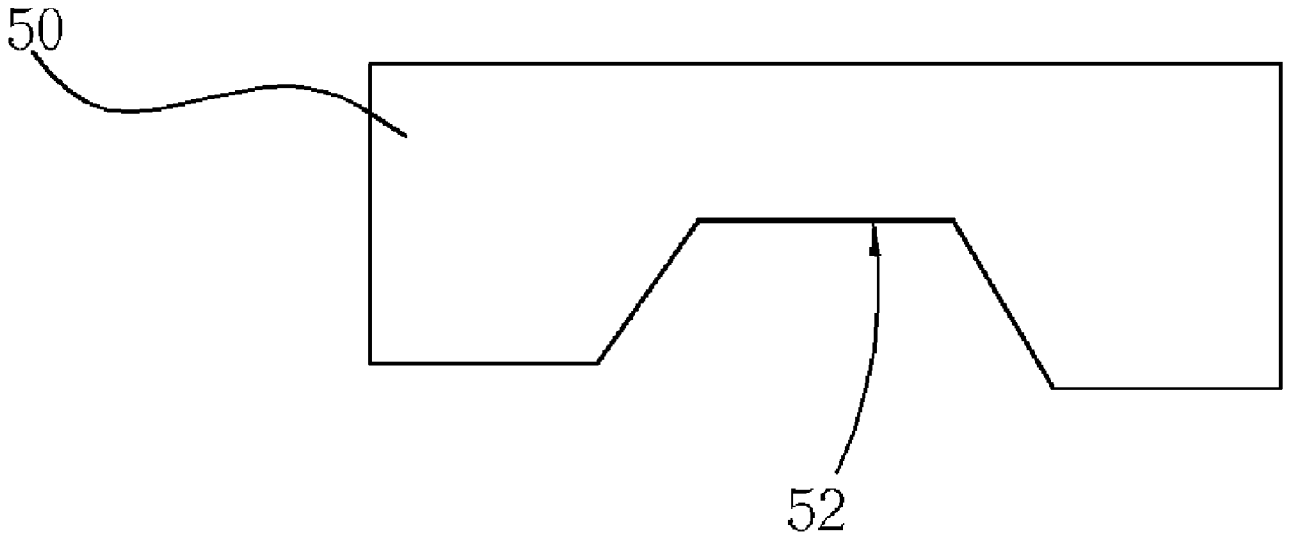
FIG. 7 is a diagram of performing insulation treatment on a mold mentioned in FIG. 6.
Figure 8:
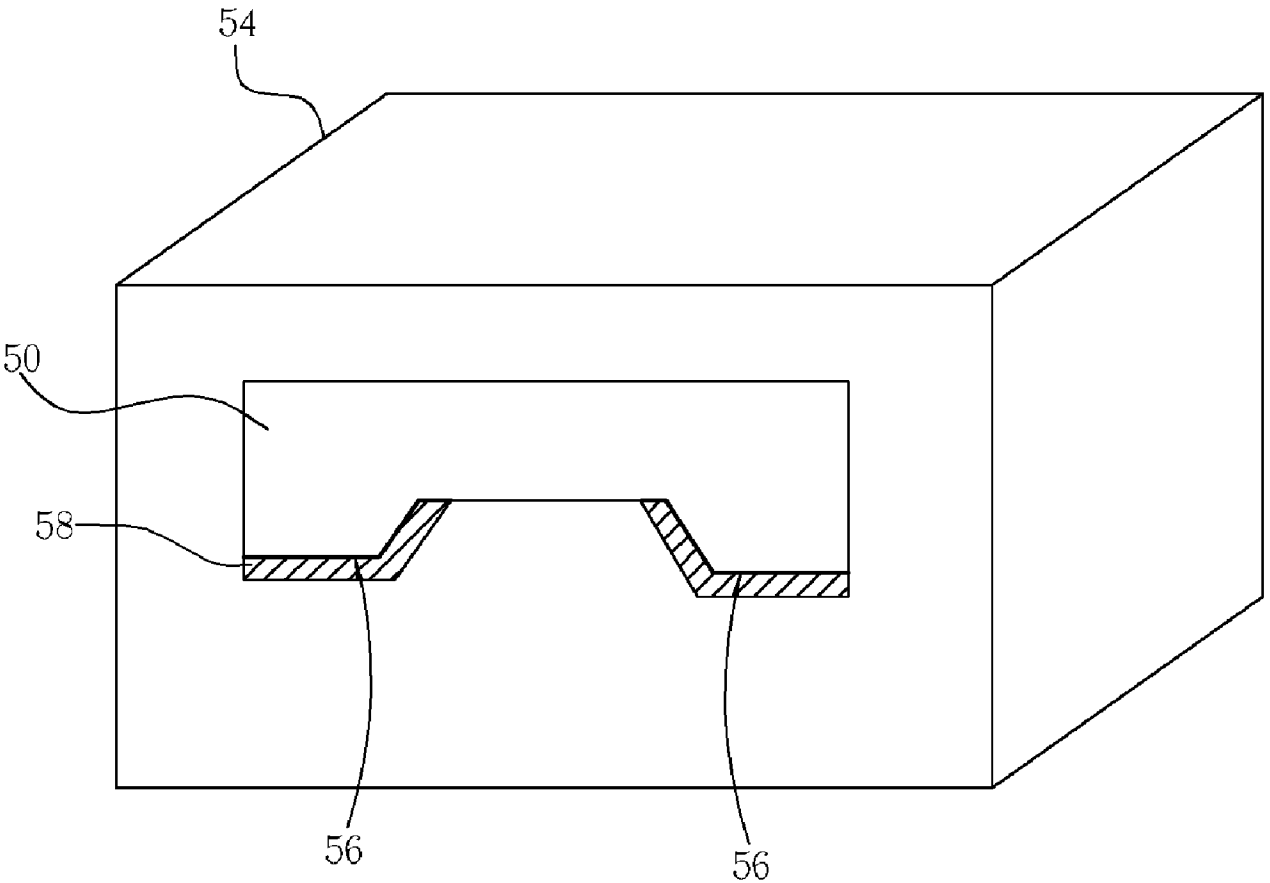
FIG. 8 is a diagram of forming a first metal surface on a surface of the mold mentioned in FIG. 6.

First, more detailed description for Step 602 is provided as follows. Please refer to FIG. 7. FIG. 7 is a diagram of performing insulation treatment on the mold 50 mentioned in FIG. 6. As shown in FIG. 7, the said insulation treatment is performed on the first partial surface 52 of the mold 50 and may be performed through a common method in the prior art, such as spraying insulating lacquer. Next, more detailed description for Step 604 is provided as follows. Please refer to FIG. 8. FIG. 8 is a diagram of forming the first metal surface 58 on the surface of the mold 50 mentioned in FIG. 6. As shown in FIG. 8, the mold 50 is disposed in the electrolytic bath 54 and is connected to a negative pole of a battery. In such a manner, metal ions with positive electrical charge in the electrolytic bath 54 can receive electrons on the negative pole. It should be noted that the first metal layer 14 is only formed on the second partial surface 56 since the insulating treatment has been performed on the first partial surface 52 of the mold 50. In addition, as mentioned in the first embodiment, before disposing the mold 50 in the electrolytic bath 54, special surface effect treatments (such as a brushed surface or a laser pattern) can be performed on the second partial surface 56 of the mold 50 first, so as to give the first metal layer 58 the corresponding surface effect, since the contour of the first metal layer 58 corresponds to the second partial surface 56 of the mold 50.

Figure 9:
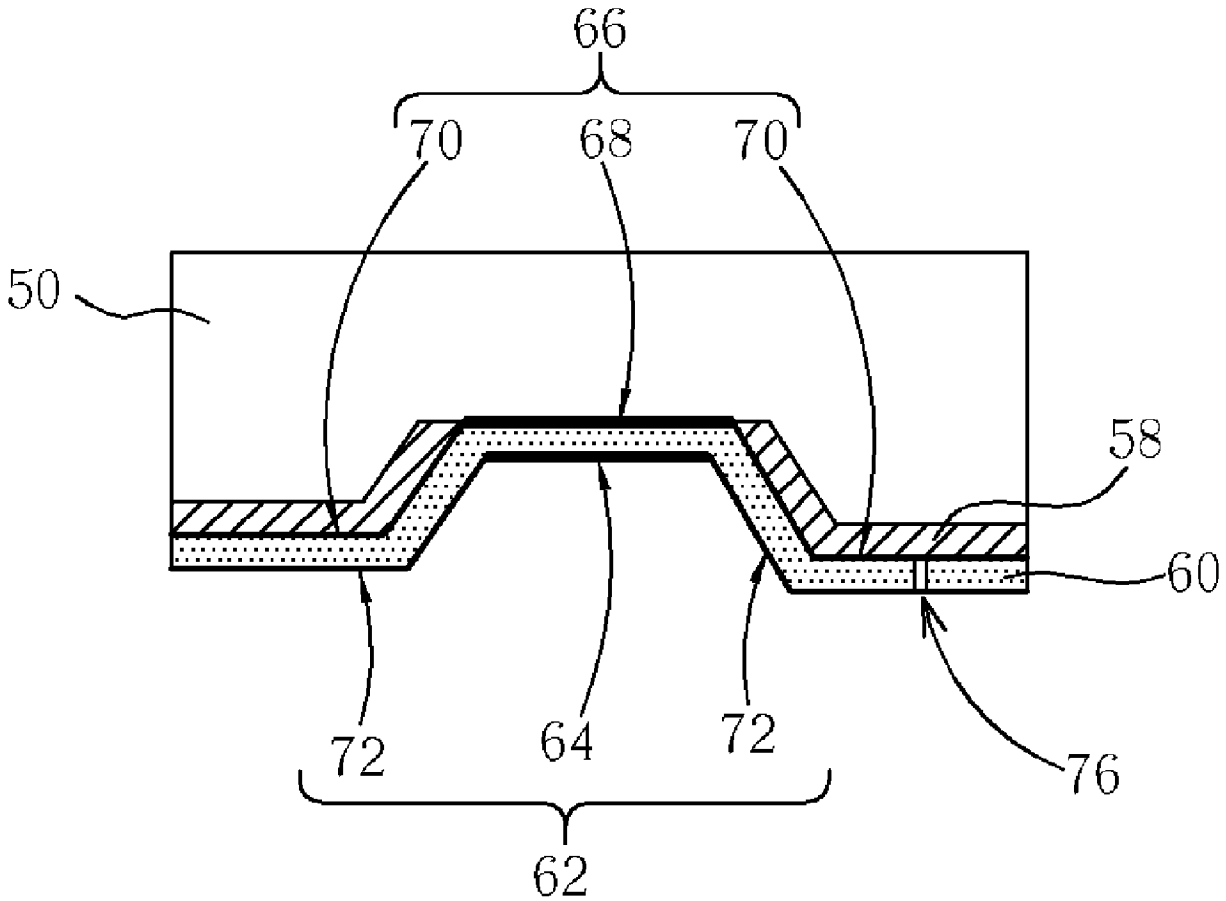
FIG. 9 is a diagram of bonding a conductive component to the mold and a first metal layer mentioned in FIG. 6.

Next, more detailed description for Step 606 and Step 608 is provided as follows. Please refer to FIG. 7 and FIG. 9 at the same time. FIG. 9 is a diagram of bonding the conductive component 60 to the mold 50 and the first metal layer 58 mentioned in FIG. 6. As shown in FIG. 9, the mold 50 can be taken out after forming the first metal layer 58 on the second partial surface 56 of the mold 50 in the electrolytic bath 54, and insulating treatment is then performed on the first partial area 64 of the first surface 62 of the conductive component 60. The next step is to bond a first partial area 68 of a second surface 66 of the conductive component 60 to the first partial surface 52 of the mold 50 shown in FIG. 7, and to bond a second partial area 70 of the second surface 66 of the conductive component 60 to the first metal layer 58. At this time, an auxiliary tool (such as a fixing clip) can be utilized to bond the conductive component 60 to the mold 50 and the first metal layer 58. The method of bonding the conductive component 60 to the mold 50 and the first metal layer 58 is not limited to the said method. It means that other common bonding methods can be also applied to the present invention. Furthermore, the conductive component 60 can be a conductor (such as a Mg—Al alloy) in itself, or can be transformed into a conductor by a conductive process (such as a conductive plastic component). As a result, if the conductive component 60 is made of Mg—Al alloy, the step of bonding the conductive component 60 to the mold 50 and the first metal layer 58 can be executed directly. On the contrary, if the conductive component 60 is made of plastic material, as mentioned above, it is necessary to perform a conductive process first (such as spraying conductive lacquer) to transform the conductive component 60 into a conductor.

Figure 10:
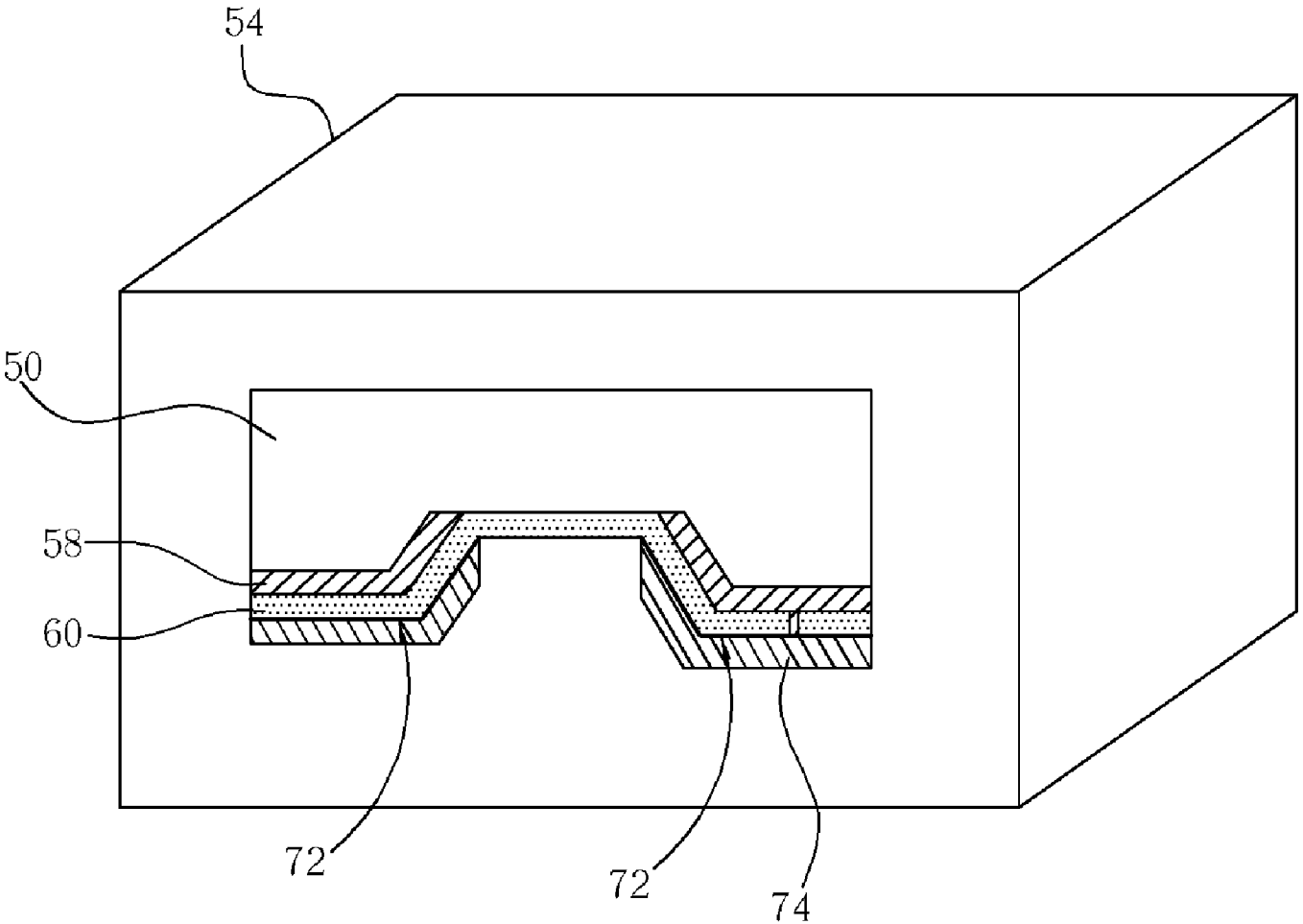
FIG. 10 is a diagram of forming a second metal layer on a surface of the conductive component mentioned in FIG. 6.

Next, please refer to FIG. 9 and FIG. 10 at the same time. FIG. 10 is a diagram of forming the second metal layer 74 on the surface of the conductive component 60 mentioned in FIG. 6. As shown in FIG. 10, after bonding the conductive component 60 to the mold 50 and the first metal layer 58, the mold 50 bonded to the conductive component 60 can be disposed in the electrolytic bath 54 for forming the second metal layer 74 on the second partial area 72 of the first surface 62 of the conductive component 60. After the said steps (i.e. Steps 602-610) are executed in turn, partial surface metallization of the conductive component 60 is completed. Furthermore, a method of generating at least one hole 76 in the conductive component 60 (as shown in FIG. 9) is effective in increasing bonding strength of the first metal layer 58 and the second metal layer 74. That is to say, when the mold 50 bonded to the conductive component 60 is disposed in the electrolytic bath 54, the hole 76 would be filled with metal precipitated from the electrolytic bath 54. In such a manner, as shown in FIG. 10, the first metal layer 58 can be connected to the second metal layer 74 by the said precipitated metal in the hole 76. As a result, the bonding strength of the first metal layer 58 and the second metal layer 74 can be further increased.

Compared with the prior art utilizing an electro-plating method or an electro-transforming method for surface metallization, the present invention involves utilizing the electro-transforming process mentioned in the aforementioned embodiments to complete surface metallization of a conductive component. As a result, the present invention not only avoids the said drawback of the electro-plating method, but also solves the problems of thicker surface and lower bonding strength arising in the electro-transforming method. Furthermore, partial surface metallization can also be achieved according to the partial electro-transforming method and the partial implanting method mentioned in the present invention for meeting special needs in structural design, such as implanting transparent windows (nonconductor) in a case of a mobile phone.

Those skilled in the art will readily observe that numerous modifications and alterations of the device and method may be made while retaining the teachings of the invention.

What is claimed is:

1. An electrochemical deposition method for surface metallization comprising:

disposing a mold in an electrolytic bath for forming a first metal layer on a surface of the mold;

bonding a first surface of a conductive component to the first metal layer;

generating a hole in the conductive component; and disposing the mold bonded to the conductive component in an electrolytic bath for forming a second metal layer on a second surface of the conductive component.

2. The electrochemical deposition method of claim 1 further comprising transforming a nonconductor into the conductive component.

3. The electrochemical deposition method of claim 1, wherein bonding the first surface of the conductive component with the first metal layer comprises bonding the first surface of the conductive component with the first metal layer by an auxiliary tool.

4. The electrochemical deposition method of claim 1 further comprising performing surface effect treatment on the surface of the mold.

5. An electrochemical deposition method for surface metallization comprising:

performing insulation treatment on a first partial surface of a mold;

disposing the mold in an electrolytic bath for forming a first metal layer on a second partial surface of the mold;

performing insulation treatment in a first partial area of a first surface of a conductive component;

bonding a first partial area and a second partial area of a second surface of the conductive component to the first partial surface of the mold and the first metal layer respectively after performing the insulation treatment in the first partial area of the first surface of the conductive component; and disposing the mold bonded to the conductive component in an electrolytic bath for forming a second metal layer in a second partial area of the first surface of the conductive component.

6. The electrochemical deposition method of claim 5 further comprising transforming a nonconductor into the conductive component.

7. The electrochemical deposition method of claim 5, wherein bonding the first partial area and the second partial area of the second surface of the conductive component to the first partial surface of the mold and the first metal layer respectively comprises bonding the first partial area and the second partial area of the second surface of the conductive component to the first partial surface of the mold and the first metal layer respectively by an auxiliary tool.

8. The electrochemical deposition method of claim 5 further comprising generating a hole in the conductive component.

9. The electrochemical deposition method of claim 5 further comprising performing surface effect treatment on the second partial surface of the mold.

* * * * *